US006581935B1

(12) United States Patent
Odom

(10) Patent No.: US 6,581,935 B1
(45) Date of Patent: Jun. 24, 2003

(54) ELECTRONIC BINGO GAME AND METHOD

(75) Inventor: Wayne Odom, Las Vegas, NV (US)

(73) Assignee: Karaway Gaming, Inc., Tucson, AZ (US)

( * ) Notice: Subject to any disclaimer, the term of this patent is extended or adjusted under 35 U.S.C. 154(b) by 0 days.

(21) Appl. No.: 09/557,948

(22) Filed: Apr. 24, 2000

(51) Int. Cl.[7] ..... A63F 3/06
(52) U.S. Cl. ..... 273/269; 463/19
(58) Field of Search ..... 463/18, 19; 273/274, 273/269

(56) References Cited

U.S. PATENT DOCUMENTS 4,624,462 A 11/1986 Itkis
4,747,600 A 5/1988 Richardson
5,380,007 A 1/1995 Travis et al.
5,536,016 A 7/1996 Thompson
5,613,910 A 3/1997 Hamano
5,639,089 A 6/1997 Matsumoto et al.
5,647,798 A 7/1997 Falciglia
5,755,619 A 5/1998 Matsumoto et al.
5,909,875 A 6/1999 Weingardt
5,935,002 A 8/1999 Falciglia
6,186,892 B1 2/2001 Frank et al.
6,203,428 B1 3/2001 Giobbi et al.

*Primary Examiner*—William M. Pierce
(74) *Attorney, Agent, or Firm*—Philip J. Anderson; Anderson & Morishita, L.L.C.

(57) ABSTRACT

An electronic Bingo game and method are set forth wherein a player inputs a wager and a Bingo card is displayed. A first set of balls is selected and compared to the numbers of the Bingo card. If a predetermined winning pattern is obtained, the player receives a reward. A second outcome set of balls is selected. If the player obtains a cover all Bingo card from the first and second outcome sets, the player is entitled to a second award. The player can select the numbers for his Bingo card and can make a desired wager up to a pre-selected maximum wager.

16 Claims, 1 Drawing Sheet

ELECTRONIC BINGO GAME AND METHOD

FIELD OF THE INVENTION

The present invention relates to games playing on an electronic device having a display. More particularly it relates to electronic Bingo games and methods.

BACKGROUND

Bingo is a well known game. In its live, non-electronic, form, each player purchases a Bingo card which presents a column/row, five-by-five, matrix. Each column is identified by a letter; B-I-N-G-O and at each coordinate in the matrix a number is provided. Often the center coordinate is marked "Free" rather than having an assigned number. After each player or participant has purchased a card, means are provided to randomly select numbers identified by the column letter and a number, e.g. B15. If a player has, in column B number 15, that coordinate is marked. Typically the universe of letters/numbers is provided on balls which are mixed and serially drawn from a cage or mixer. The selection of balls continues until a player has a card marked (corresponding numbers have been drawn) in a winning pattern. This pattern might be designated before the game as a row, column, corners, and X-pattern of a cover all (all the numbers on the winning card are covered. Thus, to play the game a number of players are required to provide a number of Bingo cards with different numbers so that a single (or few) winners can be declared.

For traditional Bingo, the requirement of having a number of players, perhaps hundreds of players, has frustrated attempts to configure Bingo as a video game which can be played by a single player. Further, Bingo prizes are fixed regardless of the number of players thus failing to provide large and/or progressive jackpots to the winners.

Since Bingo is a popular and well-known game, there is a need for an electronic game and method which permits a single player to play Bingo and which is configured to provide large and progressive jackpots.

Further there is a need for device and method which provides the player with a plurality of chances to win.

With respect to electronic games using a random number generator to select an outcome, these generators typically operate off of a clock to randomly select a number or groups of numbers to represent an outcome. If the clock is at the same time interval with respect to the random string of numbers, the same outcome will be selected. At least some persons who play gaming machines are aware of the operation of random number generators and, from time to time would like to change the clock so that the random number generator (RNG) is at another time thus affecting the outcome randomly selected. Heretofore there has been no means for a player of a game to alter the clock time to change the position of the RNG relative to the field of numbers to be selected from.

Still further there is a need for a device and method which permits the player to wager a desired amount between a pre-selected maximum and minimum amount for each game.

Still further there is a need for a device and method for playing Bingo which permits the player to select their numbers for the Bingo card.

Still further in relation to this game and other electronic games, these os a need to provide means for a player to change the RNG clock to randomly select at a different position in the random string of numbers.

SUMMARY

There is, therefore, set forth according to the present invention, an electronic device and method for playing a Bingo game which includes a data processor and a video display. Means are provided for a player to initiate play of a Bingo game such as by the player inputting a wager and prompting play. When the game is played, the processor controls the display to display a 5×5 matrix Bingo card and at each of the twenty-five coordinates of the card a discrete indicia selected from a universe of indica. Preferably, the matrix is represented as a well known Bingo card having the columns identified by the letters B-l-N-G-O and the indicia being numbers. Further, the center coordinate may be noted as "Free".

A first data structure or memory stores data corresponding to winning patterns of identified coordinates on said card as well as a corresponding pay table should the player obtain a pattern. These patterns are preferably known BINGO patterns such as a column, row, diagonal or four corners.

The processor includes a random number generator driven selection means to select, from the universe of game indicia, a pre-selected number of indicia defining a first outcome set and an additional pre-selected number of indicia to represent a second outcome set. In the preferred embodiment, the first set is 25 number/letter indicia, e.g. B12, O63 and the second set is ten additional indicia for a total of 35 indicia. As the indicia are selected, the processor compares each selected indicia to indicia on the card to determine if there is match or concordance. If so, the location of the concordance is indicated on the display much the same as marking a BINGO card. If the locations marked upon selection of the first outcome set match any pattern stored in the data structure, the player receives a first, corresponding pay table award. If all locations are indicated (a BINGO cover all) with both the first and second outcome sets, the player receives a second, cover all, award. Thus the player may win an award based upon obtaining one or more winning patterns from the first outcome set and another award based upon selection of the first and second outcome sets, if all the coordinates of the card are marked, e.g. a cover all.

In a further embodiment the player has the option of selecting the indicia for the BINGO card or having it done by the processor.

In still a further embodiment, the player my initiate a re-spin mode which alters the time of the RNG clock.

Also the device and method may provide for control of the display to display the selection of the outcome set indicia and to list the selections.

BRIEF DESCRIPTION OF THE DRAWINGS

These and other features and advantages will become appreciated as the same becomes better understood with reference to the claims, description and drawings wherein:

DESCRIPTION

Figure 1:
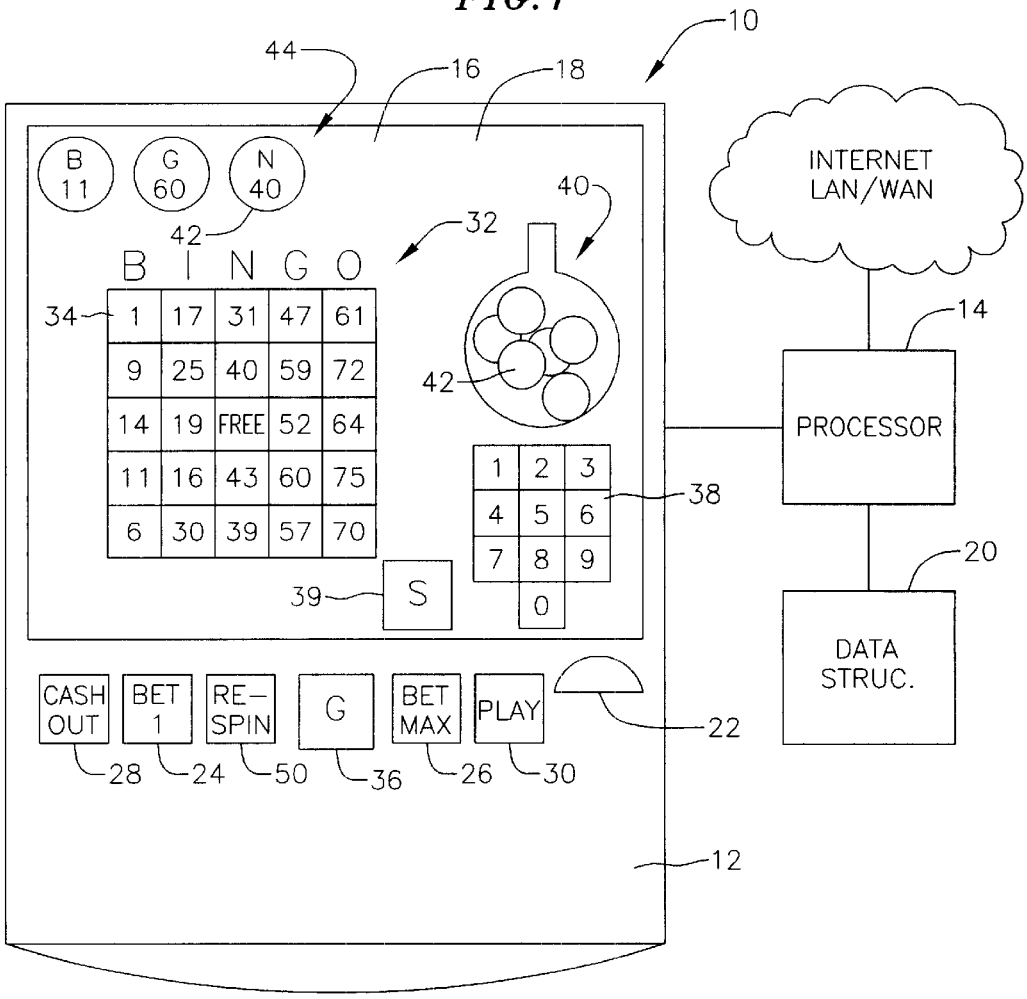
FIG. 1 shows a device for play of the game including a display displays during the play of the game.

Turning to the drawings, FIG. 1 shows a device 10 according to the present invention. The device includes a housing 12 to contain a processor 14 and the components as recited herein including a video display terminal or display 16. The display 16 may be a video terminal or plasma display and may include a touch screen 18 for the player to input selections as hereinafter described.

The processor 14 controls the various features of the device 10 including the display 16. A memory or data structure 20 is provided to store various program, operational and game play data as well as data corresponding to winning BINGO card patterns described below.

With continuing reference to FIG. 1, the device includes means for a player to make a wager. Where the device is operated as a Class II casino gaming device, these means may include a coin slot 22 at which the player inserts coins or tokens to make a wager, a cash validator to receive cash and accumulate credits for wagering in a known manner or means to accept a wager via debit or credit card. Where the device 10 is a novelty game, the means for inputting wager may include means for wagering fictitious credits or the like. For purposes of the following description, the device 10 is a gaming device of the type provided in casinos.

The waging input means may also include a Bet 1 button 24 by which, in a known manner, the player can wager a single unit or credit and a Bet Max button 26 by which the player may wager the maximum permitted by the device 10. Also provided is a cash out button 28 to enable the player to cash out the accumulated wagering credits from the play of the device 10 and a Play button 30 by which the player prompts the play of the device 10.

The various buttons described above may be embodied as locations on the touch screen 18 and display 16.

To play the game the player first initiates play by making a wager by the wagering means. The wager can be one unit or credit up to a maximum amount permitted by the device 10. The wagering means communicates with the processor 14 to prompt the processor 14 to control the display 16 to display a Bingo card 32. As is known, the card 32 is a 5×5 matrix having five columns and rows, with the columns identified by the letters B-I-N-G-O. The card matrix defines twenty-five coordinate positions 34. At each coordinate position 34 there is provided a discrete indicia shown as numbers. In the preferred embodiment where the universe of indicia, i.e. numbers, is seventy-five, one-fifth of the numbers is allocated to each column. Thus in column B, each coordinate position 34 can be assigned a number selected from the group of numbers 1–15, for column I numbers 16–30, for column N numbers 31–45, for column G numbers 46–60 and for column O numbers 61–75. When play is initiated, the processor 14 randomly assigns a unique number from the appropriate group to each coordinate position 34. If the player wishes to play the card 32 with the processor assigned numbers, he/she prompts play by depressing the Play button 30.

The center coordinate may be displayed as "free" indicating that that coordinate will always be marked for the game.

If the player wishes the processor 14 to randomly select and position a different set of numbers on the card 32, the player depresses or touches on the touch screen 18 a "Generate" button.

Means are provided for the player to select their own numbers for each coordinate position for the allocated group of numbers. These means may be a keypad 38 displayed on the display 16 at which the player, through the touch screen 18, selects the numbers. Thus the player can select the numbers for the card 32 or can have the processor 14 make the selection. To select their numbers, the player depresses a select button 39 on the device 10 or touch screen 18 and uses the key pad or other suitable input device to select the number for each coordinate 34 position as selected from the allocated groups of numbers for each column as described above.

Once the card 32 has been completed, the player prompts play of the game.

When play is prompted, the processor 14 controls the display 16 to display the selection of a first and second outcome set of numbers randomly selected by a random number generator (RNG) in the processor 14 from the universe set of numbers of B1–15, I16–30, N31–45, N46–60 and O61–75. The processor 14 may control the display 14 to display, during the selection as described above, a hopper or mixing cage 40 mixing balls 42 each bearing a letter/number combination and sequentially issuing a selected ball to be displayed at call board area 44 on the display 14.

The processor controls the selection to select a first outcome set of a pre-selected number of indicia (letter/number balls), preferably twenty-five balls 42. As each letter/number indicia is selected, the processor 14 compares the selection to the indicia on the card 32. If a concordance occurs (the letter/number on the ball matches a coordinate location letter/number) the processor controls the display 16 to indicate or mark that coordinate position 34. The marking may be by flashing the coordinate position, displaying it in a different color, by superimposing a mark at the coordinate position 34 or by any other suitable means.

Figure 2:
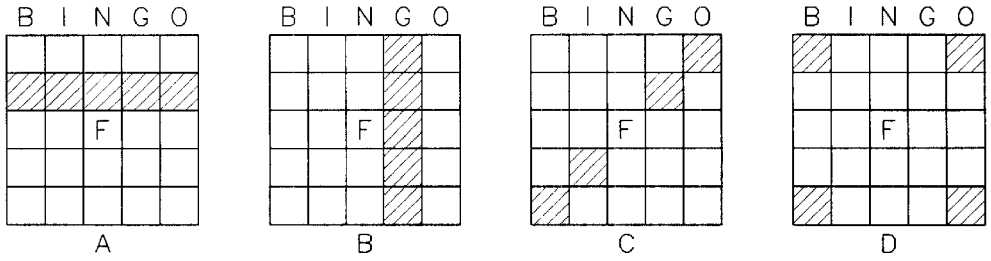
FIG. 2 shows winning patterns.

After the first outcome set of twenty-five indica has been selected, the processor 14 compares the marked or indicated coordinate 34 positions corresponding to the selection to the winning pattern data stored in the data structure 20. If a winning pattern of marked coordinate positions 34 on the card 32 has been obtained, the player is entitled to a reward based upon their wager and the predetermined pay table award for obtaining that particular pattern. With reference to FIG. 2, a group of pre-selected winning Bingo patterns is shown. Pattern A shows a row, pattern B shows a column, pattern C shows a diagonal and pattern D shows four corners. If the marked coordinate positions 34 on the card 32 match one or more of the patterns of FIG. 2 based upon the selection of the first outcome set, the player is entitled to a reward. Table A sets forth an example of a pay table which may be provided for the game. It is to understood that other pay tables as well as patterns could be pre-selected and stored or selected by the player.

TABLE A

| | 1 Unit | 2 Units | 3 Units | 4 Units | 5 Units |
|---|---|---|---|---|---|
| 1 Way | 10 | 20 | 30 | 40 | 50 |
| 2 Way | 20 | 40 | 60 | 80 | 100 |
| 3 Way | 40 | 80 | 120 | 160 | 200 |
| 4 Way | 80 | 160 | 240 | 320 | 400 |
| 5 Way | 100 | 200 | 300 | 400 | 500 |
| 6 Way | 200 | 400 | 600 | 800 | 1000 |
| 7 Way | 400 | 800 | 1200 | 1600 | 2000 |
| 8 Way | 1000 | 2000 | 3000 | 4000 | 5000 |
| 9 Way | 2000 | 4000 | 6000 | 8000 | 10 K* |
| 10 Way | 3000 | 6000 | 9000 | 12 K | 15 K |
| 11 Way | 5 K | 10 K | 15 K | 20 K | 25 K |
| Cover All** | 10 K | 20 K | 30 K | 40 K | Pro*** |

*K = 1000
**From both the first and second outcome sets
***Progressive Jackpot

For Table A, each way refers to a winning pattern such as a row, column, diagonal or four corner card obtained by the player. Thus if a player has 2 columns, 2 rows and a diagonal marked upon selection of the first outcome set, he would have a 5 way card and would receive an award based upon Table A. If a player obtains a cover all from the first outcome set alone or with the additional draws of the second outcome set, they would receive an award for the cover all.

It is to be understood that other pay tables could be adopted as well.

After the processor 14 has determined any awards based upon the selection of the first outcome set, the processor randomly selects a second outcome set of a pre-selected number of indicia. Preferably, where the first outcome set is twenty-five indicia, the second outcome set if ten indicia (balls 42) for a total selection of thirty-five indicia. As with the first outcome set, as the second outcome set is selected, the processor 14 compares the selected indicia (letter/number balls 42) with the columns and numbers of the card 32. If a ball matches a coordinate position number, that coordinate position 34 is marked or indicated. Further the balls 42 selected are displayed in the call board area 44 and are preferably displayed in a different color in the call board area 44 and on the card 32 to distinguish the first and second selection sets. When the selection has been completed, the processor 14 determines whether all of the coordinate positions 34 have been marked representing a cover all for the card 32. If, from the thirty-five letter/number balls 42, all twenty-five coordinate positions 34 have been marked, i.e. the card numbers and column letters can be found on twenty-five balls from the first and second selection set, the player is entitled to a second award.

To provide for a progressive second award, a portion of each wager such as 2½ percent may be allocated to a progressive jackpot. With reference to FIG. 1, to provide even larger jackpots, a plurality of like devices 10 have their processors 14 linked through an Internet, LAN (local area network) or WAN (wide area network) whereupon a portion of the wagers from all linked machines are allocated to a mutual jackpot to be awarded upon the player obtaining a cover all. This progressive may, based upon the odds of obtaining a cover all, start at 50,000 units.

To replay the card 32, the player enters another wager and prompts play. To select a different card 32, the player may prompt erase and make their own selection or prompt the processor to select the numbers for the card 32 coordinate positions 34.

To cash out or receive a pay, the player depresses the cash out button 28 and coins or tokens are dispensed.

If the player is dissatisfied with the balls that are being selected, means are provided for the player to alter the clock setting or position of the RNG. These means may be embodied as a re-spin button 50. Accordingly, if the player has played a card 32 a plurality of times without success, he may feel that the RNG is not timed so as to select a winning outcome and that another RNG clock setting or position may result in the random the selection of a winning outcome. To change the RNG clock position, before prompting play, the player would depress the re-spin button 50 which would either advance or retard the RNG clock and alter the position relative to the data string where the selections are made. This may, in the player's mind, provide them with a better chance of obtaining a winning outcome.

As can be appreciated the device and method of play provides the player with several opportunities to win. They may obtain one or more winning patterns from the first outcome set or they may obtain a cover all upon selection of the second outcome set. Further the method and device permits a single player to play Bingo. The player can also select the numbers for their cards 32 and can alter the clock setting for the RNG.

While I have shown and described certain embodiments of the present invention, it is to be understood that it is subject to many changes and modifications without departing from the spirit and scope of the appended claims. For example, as stated above, the jumping symbol could be any other symbol consistent with the theme and overall presentation of the game.

I claim:

1. An electronic device for playing a Bingo game comprising:

a data processor;

a display;

means for a player to initiate play of a Bingo game, said processor controlling the display to display a standard 5×5 matrix Bingo card and at each coordinate of the card a number selected from a universe of Bingo numbers;

a first data structure storing data corresponding to each of a plurality winning patterns of identified coordinates on said card;

means for the processor to select from the of said Bingo numbers a pre-determined number of Bingo numbers defining a first outcome set and an additional pre-determined number of indicia to represent a second outcome set; and said processor programmed to (i) compare said indicia sets to the indicia of the card and if a concordance occurs, (ii) to control the display to identify the coordinate location of the concordance on the card, (iii)(a) to compare the pattern of identified coordinates from the first outcome set to the patterns stored at the first data structure and to issue an award to the player based upon the number of said winning patterns occurring on said card and (b) to compare the identified locations from the first and second sets to determine additional identified coordinates of the card and, if all of the coordinates are identified, issue an award to the player.

2. The device of claim 1 wherein said first data structure includes data corresponding to card patterns of any column, four corners, a diagonal, and any row.

3. The device of claim 1 wherein said first outcome set is twenty-five Bingo numbers.

4. The device of claim 1 wherein the second outcome set is ten Bingo numbers.

5. The device of claim 1 wherein the first outcome set is twenty-five Bingo numbers and the second outcome set is ten Bingo numbers.

6. The device of claim 1 wherein said processor is programmed to control the display to display each Bingo number selected.

7. The device of claim 1 wherein said processor is programmed to control the display to show the first and second outcome sets in different color.

8. The device of claim 1 including means for the player to select the Bingo numbers for any location on the card matrix from said universe.

9. The device of claim 1 wherein said processor includes a clock operated random number generator (RNG) and further including means for altering the timing position of the clock.

10. An electronic device for playing a Bingo game comprising:

a data processor;

a display;

means for a player to initiate play of a Bingo game, said processor controlling the display to display a standard 5×5 matrix Bingo card having a center free coordinate and at each remaining coordinate of the card a discrete Bingo number selected from a universe of Bongo numbers;

a first data structure storing data corresponding to each of a plurality winning patterns of identified coordinates on said card;

means for the processor to select from the of said universe of Bingo numbers a pre-selected number of Bongo numbers defining a first outcome set and an additional pre-selected number of Bingo numbers to represent a second outcome set, the sum of said first outcome set including at least 24 indicia; and said processor programmed to (i) compare said Bingo number sets to the numbers of the card and if a concordance occurs, (ii) to control the display to identify the coordinate location of the concordance on the card, (iii)(a) to compare the pattern of identified coordinates from the first outcome set to the patterns stored at the first data structure and to issue an award to the player based upon the number of said winning patterns occurring on said card and (b) to compare the identified locations from the first and second sets to determine any additional identified coordinates and if all coordinates of the card are identified and, if so, issue a cover all award to the player.

11. The device of claim 10 wherein said first outcome set is twenty-five Bingo numbers.

12. The device of claim 10 wherein the second outcome set is ten Bingo numbers.

13. The device of claim 10 wherein the first outcome set if twenty-five Bingo numbers and the second outcome set is ten Bingo numbers.

14. The device of claim 10 wherein said processor is programmed to control the display to display each Bingo number selected.

15. An electronic device for playing a Bingo game comprising:

a data processor;

a display;

means for a player to initiate play of a Bingo game, said processor controlling the display to display a standard 5×5 matrix Bingo card having a center free coordinate and at each remaining coordinate of the card a discrete Bingo number selected from a universe of Bingo numbers;

a first data structure storing data corresponding to each of a plurality of winning patterns of identified coordinates on said card;

means for the processor to select from the of said Bingo numbers universe a pre-selected number of Bingo numbers defining at least one outcome set; and said processor programmed to (i) compare said indicia sets to the Bingo numbers of the card and if a concordance occurs, (ii) to control the display to identify the coordinate location of the concordance on the card and (iii) to compare the pattern of identified coordinates from the at least one outcome set to the patterns stored at the first data structure and to issue an award to the player based upon the number of said winning patterns occurring on said card.

16. The device of claim 15 including issuing an award based upon the schedule of:

| | 1 Unit | 2 Units | 3 Units | 4 Units | 5 Units |
|---|---|---|---|---|---|
| 1 Pattern | 10 | 20 | 30 | 40 | 50 |
| 2 Patterns | 20 | 40 | 60 | 80 | 100 |
| 3 Patterns | 40 | 80 | 120 | 160 | 200 |
| 4 Patterns | 80 | 160 | 240 | 320 | 400 |
| 5 Patterns | 100 | 200 | 300 | 400 | 500 |
| 6 Patterns | 200 | 400 | 600 | 800 | 1000 |
| 7 Patterns | 400 | 800 | 1200 | 1600 | 2000 |
| 8 Patterns | 1000 | 2000 | 3000 | 4000 | 5000 |
| 9 Patterns | 2000 | 4000 | 6000 | 8000 | 10 K* |
| 10 Patterns | 3000 | 6000 | 9000 | 12 K | 15 K |
| 11 Patterns | 5 K | 10 K | 15K | 20 K | 25 K |
| Cover All** | 10 K | 20 K | 30K | 40 K | Pro*** |

*K = 1000

**From both the first and second outcome sets

***Progressive Jackpot.

* * * * *